US010916398B2

(12) United States Patent
Mizuno et al.

(10) Patent No.: US 10,916,398 B2
(45) Date of Patent: Feb. 9, 2021

(54) ELECTROMAGNETIC RELAY

(71) Applicant: ANDEN CO., LTD., Anjo (JP)

(72) Inventors: Wataru Mizuno, Anjo (JP); Tomoaki Tanaka, Anjo (JP); Makoto Kamiya, Anjo (JP)

(73) Assignee: DENSO ELECTRONICS CORPORATION, Anjo (JP)

( * ) Notice: Subject to any disclaimer, the term of this patent is extended or adjusted under 35 U.S.C. 154(b) by 142 days.

(21) Appl. No.: 16/248,836

(22) Filed: Jan. 16, 2019

(65) Prior Publication Data

US 2019/0148094 A1 May 16, 2019

Related U.S. Application Data

(63) Continuation of application No. PCT/JP2017/020743, filed on Jun. 5, 2017.

(30) Foreign Application Priority Data

Jul. 19, 2016 (JP) ..... 2016-141453

(51) Int. Cl.
*H01H 50/16* (2006.01)
*H01H 50/30* (2006.01)
(Continued)

(52) U.S. Cl.
CPC ..... *H01H 50/163* (2013.01); *H01H 50/02* (2013.01); *H01H 50/30* (2013.01);
(Continued)

(58) Field of Classification Search
CPC ..... H01H 50/163; H01H 50/30; H01H 50/02; H01H 50/44; H01H 50/641; H01H 50/38; H01H 50/546; H01H 2050/446
See application file for complete search history.

(56) References Cited

U.S. PATENT DOCUMENTS 3,543,204 A * 11/1970 Cox ..... H02K 41/00 335/267
2006/0050466 A1 3/2006 Enomoto et al.
(Continued)

FOREIGN PATENT DOCUMENTS

JP 2005026182 A 1/2005
JP 2005347118 A 12/2005
JP 2013-506948 A 2/2013

*Primary Examiner* — Mohamad A Musleh
(74) *Attorney, Agent, or Firm* — Harness, Dickey & Pierce, P.L.C.

(57) ABSTRACT

An electromagnetic relay includes a mobile component movable at time of energization and de-energization of a coil, and a fixed component immovable at the time of energization and de-energization of the coil. A damping space is provided between the mobile component and the fixed component and changes in volume with the movement of the mobile component. A gap provided between the mobile component and the fixed component serves as a passage that allows gas to flow into or out of the damping space when the damping space changes in volume. A size of the gap is set such that a pressure is generated in the damping space to cause a damping force acting on the mobile component when the damping space changes in volume.

7 Claims, 7 Drawing Sheets

(51) Int. Cl.

| | |
|---|---|
| ***H01H 50/02*** | (2006.01) |
| ***H01H 50/44*** | (2006.01) |
| ***H01H 50/64*** | (2006.01) |
| *H01H 50/38* | (2006.01) |
| *H01H 50/54* | (2006.01) |

(52) U.S. Cl.
CPC ..... *H01H 50/44* (2013.01); *H01H 50/641* (2013.01); *H01H 50/38* (2013.01); *H01H 50/546* (2013.01); *H01H 2050/446* (2013.01)

(56) References Cited

U.S. PATENT DOCUMENTS

| | | | | |
|---|---|---|---|---|
| 2012/0256714 | A1 | 10/2012 | Hartmann et al. | |
| 2013/0183174 | A1* | 7/2013 | Hampton ..... | F04B 17/04 417/410.1 |
| 2014/0225691 | A1* | 8/2014 | Tanaka ..... | H01H 50/00 335/267 |

* cited by examiner

ELECTROMAGNETIC RELAY

CROSS REFERENCE TO RELATED APPLICATION

The present application is a continuation application of International Patent Application No. PCT/JP2017/020743 filed on Jun. 5, 2017, which designated the United States and claims the benefit of priority from Japanese Patent Application No. 2016-141453 filed on Jul. 19, 2016. The entire disclosures of all of the above applications are incorporated herein by reference.

TECHNICAL FIELD

The present disclosure relates to an electromagnetic relay for making and breaking an electric circuit.

BACKGROUND

In a conventional electromagnetic relay, a movable core is attracted toward a fixed core by a force of attraction, and a movable contact follows the movable core to come into contact with and separate from a fixed contact.

SUMMARY

According to at least one embodiment of the present disclosure, an electromagnetic relay includes: a coil configured to form a magnetic field when energized; a fixed component including a fixed core constituting a magnetic circuit and configured to generate attraction when the coil is energized, the fixed component being immovable at time of energization and de-energization of the coil; a mobile component including a movable core constituting a magnetic circuit and attracted toward the fixed core by the attraction, the mobile component being movable at the time of energization and de-energization of the coil; a fixed contact fixed to a base; and a movable contact configured to follow the movable core to come into contact with and separate from the fixed contact. A damping space is provided between the mobile component and the fixed component and changes in volume with a movement of the mobile component. A gap is provided between the mobile component and the fixed component, and the gap serves as a passage that allows gas to flow into or out of the damping space when the damping space changes in volume. A size of the gap is set such that a pressure is generated in the damping space to cause a damping force acting on the mobile component when the damping space changes in volume.

DETAILED DESCRIPTION

Figure 1:
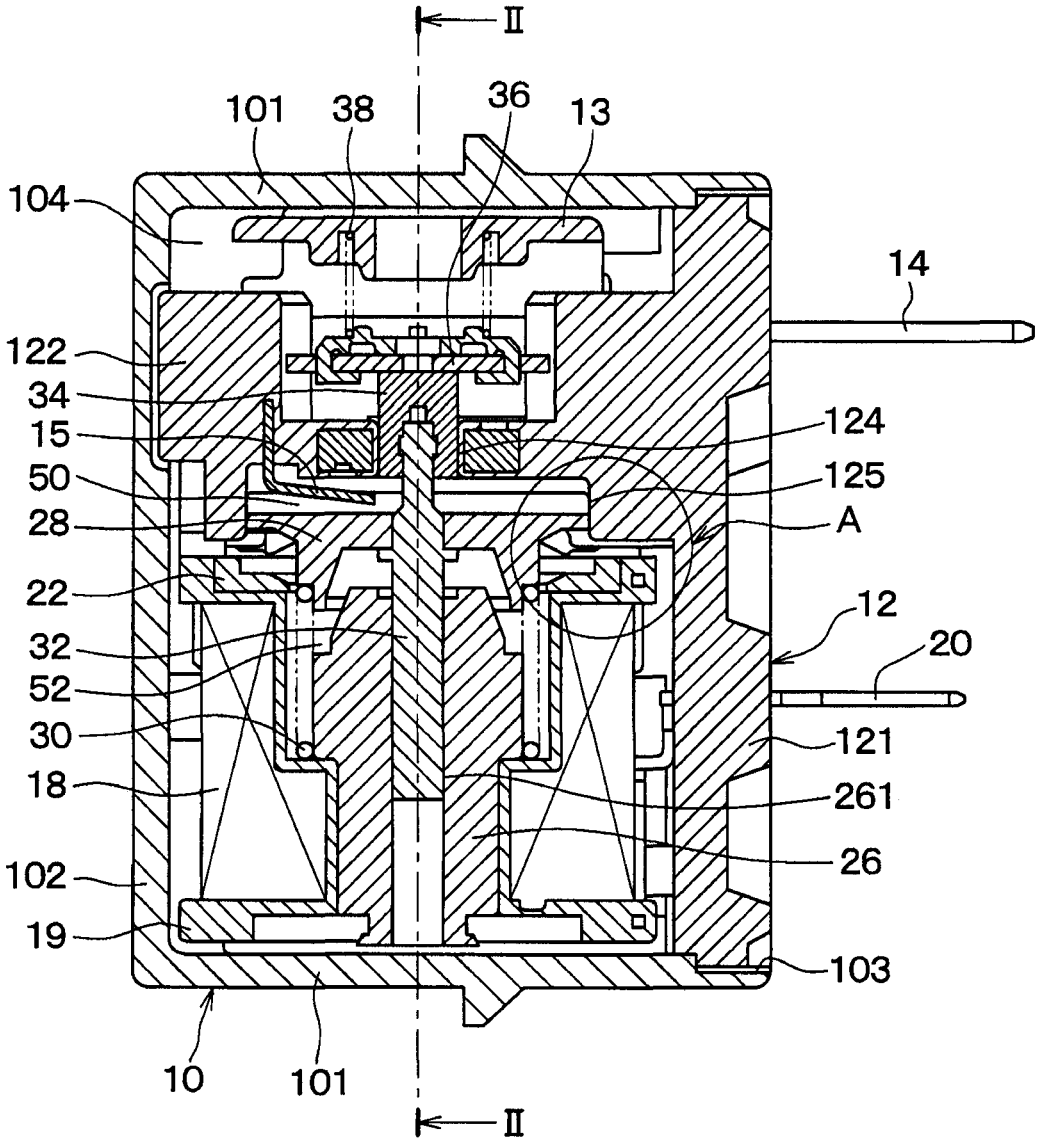
FIG. 1 is a cross-sectional view illustrating an electromagnetic relay according to at least one embodiment of the present disclosure.

Hereinafter, multiple embodiments for implementing the present disclosure will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Figure 2:
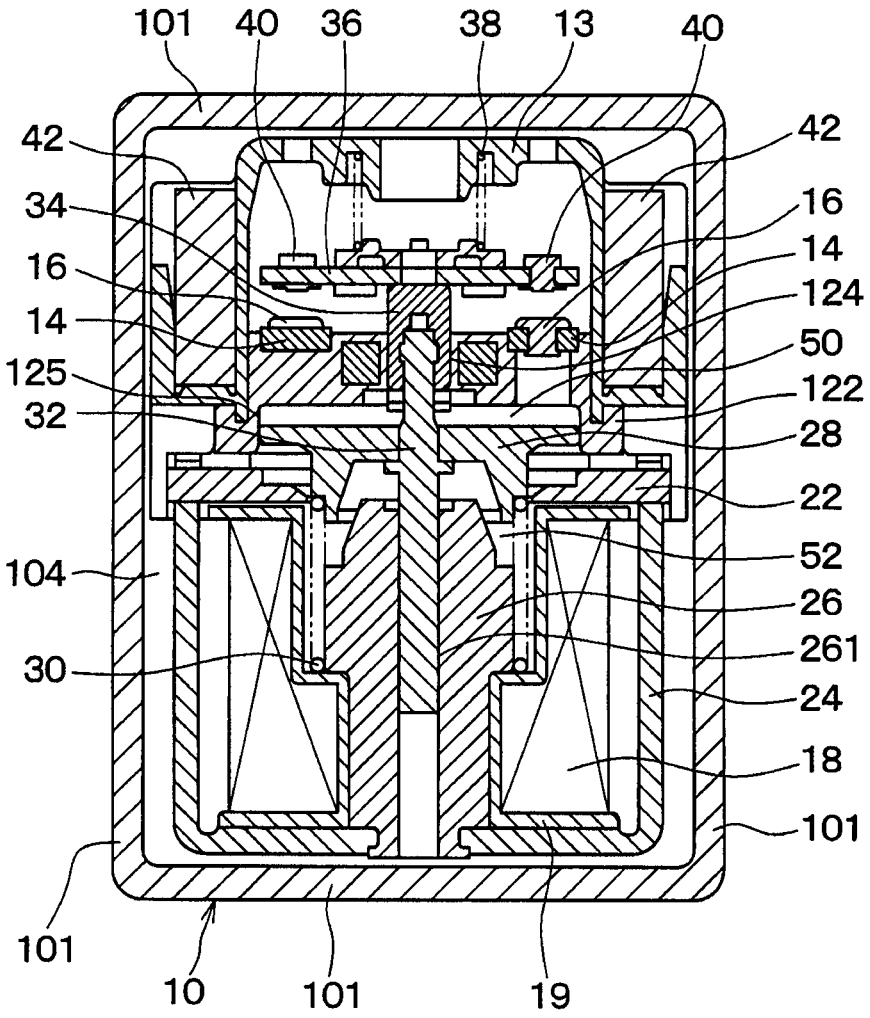
FIG. 2 is a cross-sectional view taken along line II-II of FIG. 1.
Figure 3:
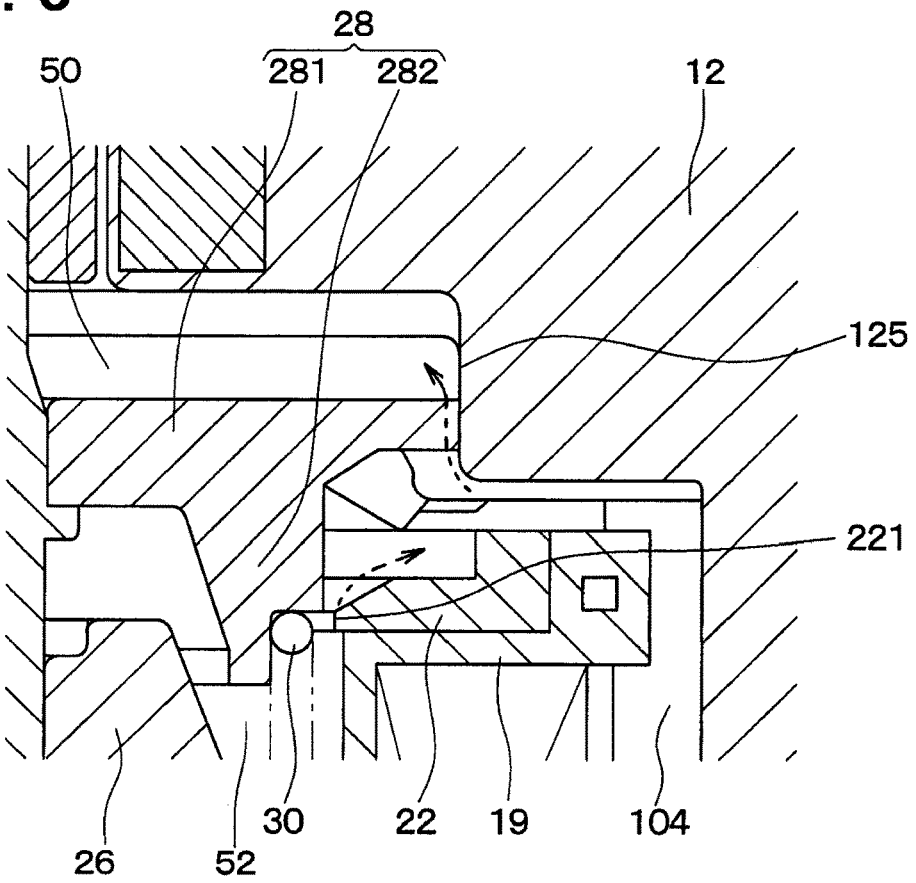
FIG. 3 is an enlarged cross-sectional view of area A in FIG. 1.

A first embodiment of the present disclosure will be described. As illustrated in FIGS. 1 to 3, an electromagnetic relay according to the present embodiment includes a case 10 made of resin. The case 10 has the shape of a bottomed square tube including four case side walls 101, one case bottom 102, and a case opening 103 provided on a surface facing the case bottom 102. A housing space 104 is formed inside the case 10 and open to the outside through the case opening 103.

A base 12 made of resin includes a base bottom 121 fitted to the case 10 to close the case opening 103, and a base body 122 protruding from the base bottom 121 toward the case bottom 102.

The base 12 further includes a base through hole 124 into which an insulator 34 (to be described) is inserted, and a base recess 125 having a concave shape into which a movable core 28 (to be described) is inserted. The housing space 104 is demarcated by the case 10 and the base bottom 121.

The base 12 is also joined to a spring receiving member 13 for holding a contact pressure spring 38 and a permanent magnet 42 to be described.

The base 12 is insert-molded with a pair of fixed pieces 14 made of a conductive metal plate and a stopper 15 made of a metal plate bent in an L shape as inserts.

One end of the fixed piece 14 is fixed to the base body 122 and positioned in the housing space 104, while the other end of the fixed piece 14 passes through the base bottom 121 and protrudes to the outside.

A fixed contact 16 made of conductive metal is caulked and fixed to the end of the fixed piece 14 on the side of the housing space 104. The end of the fixed piece 14 on the side of the outside space is connected to an external electric circuit (not shown). The fixed piece 14 and the fixed contact 16 are each an example of a fixed contact fixed to the base 12.

One end of the stopper 15 is fixed to the base body 122, while the other end of the stopper 15 faces the movable core 28 to be described.

A coil 18 having a cylindrical shape is disposed in the housing space 104 and forms a magnetic field when energized. The coil 18 is wound around a spool 19 made of resin. The spool 19 has a flanged cylindrical shape, and a fixed core 26 and a return spring 30 (to be described) are housed in an inner peripheral space of the spool 19.

A pair of coil terminals 20 made of conductive metal is connected to the coil 18. The coil terminal 20 passes through the base bottom 121 so that an end thereof protrudes to the outside of the electromagnetic relay. The coil terminal 20 is connected to an ECU (not shown) via an external harness, and the coil 18 is energized via the external harness and the coil terminal 20.

A plate 22 made of a ferromagnetic metal material and having a disk shape is disposed in close contact with the spool 19 on the side of the base body 122. The plate 22 has a plate through hole 221 into which the movable core 28 (to be described) is inserted.

A yoke 24 made of a ferromagnetic metal material is disposed to the spool 19 on the side away from the base body and on the outer peripheral side. The plate 22 and the yoke 24 are fixed to the base 12.

The fixed core 26 made of a ferromagnetic metal material and having a stepped cylindrical shape is disposed in an inner peripheral space of the spool 19. A small diameter portion of the fixed core 26 is airtightly inserted into the spool 19 and held by the yoke 24. The fixed core 26 has a fixed core guide hole 261 into which a shaft 32 (to be described) is slidably inserted. The fixed core guide hole 261 passes through the fixed core 26 from an end surface on one end thereof to an end surface on the other end thereof.

The movable core 28 made of a ferromagnetic metal material is disposed between the base body 122 and the plate 22. The movable core 28 includes a movable core disk 281 that is disk-shaped to be inserted into the base recess 125, and a movable core cylinder 282 that has a substantially cylindrical shape and extends from the movable core disk 281 toward the fixed core 26 to be inserted into the plate through hole 221.

The return spring 30 for energizing the movable core 28 in a direction away from the fixed core is disposed by being held between the spool 19 and the movable core 28 in the inner peripheral space of the spool 19. When the coil 18 is energized, the movable core 28 is attracted toward the fixed core 26 against the return spring 30. The plate 22, the yoke 24, the fixed core 26, and the movable core 28 make up a magnetic path of a magnetic flux induced by the coil 18.

The shaft 32 made of metal passes through the movable core 28 and is airtightly fixed thereto. One end of the shaft 32 extends in the direction away from the fixed core and the insulator 34 made of resin having high electrical insulation is fitted and fixed to the one end of the shaft 32. The other end of the shaft 32 is slidably and airtightly inserted into the fixed core guide hole 261. The insulator 34 is slidably and airtightly inserted into the base through hole 124.

The movable core 28, the shaft 32, and the insulator 34 are joined by press fitting or the like to operate in an integrated manner. The movable core 28, the shaft 32, and the insulator 34 will be hereinafter collectively referred to as an integrated body including the movable core 28.

A movable piece 36 made of a conductive metal plate is disposed in the housing space 104. The contact pressure spring 38 for energizing the movable piece 36 toward the insulator 34 is disposed between the movable piece 36 and the spring receiving member 13. Two movable contacts 40 made of conductive metal are caulked and fixed to the movable piece 36 at positions facing the two fixed contacts 16. The movable piece 36 and the movable contacts 40 are each an example of a movable contact that follows the movable core 28 to come into contact with and separate from the fixed contact.

The pair of permanent magnets 42 is fixed to the spring receiving member 13 to form a magnetic field in the area of contact and separation between the fixed contact 16 and the movable contact 40 and elongate an arc generated between the fixed contact 16 and the movable contact 40. The permanent magnets 42 are disposed to face each other along a direction in which the pair of areas of contact and separation is arranged (a lateral direction in FIG. 2).

A first damping space 50 is formed in the base recess 125 and changes in volume with a movement of the integrated body including the movable core 28. The first damping space 50 is demarcated by the base 12, the movable core 28, the shaft 32, and the insulator 34.

The base 12 is airtightly fitted to the insulator 34, and the first damping space 50 communicates with the housing space 104 through a minute gap between the inner wall surface of the base 12 forming the base recess 125 and the outer peripheral surface of the movable core disk 281.

A second damping space 52 is formed on the inner peripheral side of the spool 19 and changes in volume with a movement of the integrated body including the movable core 28. The second damping space 52 is demarcated by the spool 19, the plate 22, the fixed core 26, the movable core 28, and the shaft 32.

The spool 19 is in close contact with the plate 22 and airtightly fitted to the fixed core 26, and the second damping space 52 communicates with the housing space 104 through a minute gap between the inner peripheral surface of the plate 22 forming the plate through hole 221 and the outer peripheral surface of the movable core cylinder 282.

The movable core 28, the shaft 32, and the insulator 34 are each an example of a mobile component that is movable at time of energization and de-energization of the coil 18. The base 12, the spool 19, the plate 22, and the fixed core 26 are each an example of a fixed component that is immovable at the time of energization and de-energization of the coil 18.

Next, the operation of the electromagnetic relay according to the present embodiment will be described. First, when the coil 18 is energized, the integrated body including the movable core 28 is attracted toward the fixed core 26 by the attraction generated in the fixed core 26 against the return spring 30, and the movable piece 36 is energized by the contact pressure spring 38 to follow the integrated body including the movable core 28. As a result, the two movable contacts 40 come into contact with the two fixed contacts 16 so that a pair of fixed pieces 14 becomes conductive.

After the movable contacts 40 come into contact with the fixed contacts 16, the integrated body including the movable core 28 further moves to a position at which the movable core 28 comes into contact with the fixed core 26.

At this time, the first damping space 50 increases in volume to have negative pressure with the movement of the integrated body including the movable core 28, so that gas flows into the first damping space 50 from the housing space 104 through the gap between the inner wall surface of the base 12 forming the base recess 125 and the outer peripheral surface of the movable core disk 281, as indicated by a broken arrow in FIG. 3.

Moreover, the second damping space 52 decreases in volume to have positive pressure with the movement of the integrated body including the movable core 28, so that gas flows out to the housing space 104 from the second damping space 52 through the gap between the inner peripheral surface of the plate 22 forming the plate through hole 221 and the outer peripheral surface of the movable core cylinder 282, as indicated by a broken arrow in FIG. 3.

In the present embodiment, the gap between the inner wall surface of the base 12 forming the base recess 125 and the outer peripheral surface of the movable core disk 281 is set such that a pressure is generated in the first damping space 50 to cause a damping force acting on the integrated body including the movable core 28 when the first damping space 50 changes in volume.

The gap between the inner peripheral surface of the plate 22 forming the plate through hole 221 and the outer peripheral surface of the movable core cylinder 282 is set such that a pressure is generated in the second damping space 52 to cause a damping force acting on the integrated body including the movable core 28 when the second damping space 52 changes in volume.

Thus, when the movable core 28 is attracted toward the fixed core 26, the pressure in each of the first damping space 50 and the second damping space 52 acts on the movable core 28 and thereby generate the damping force, which decreases the speed of the integrated body including the movable core 28. This reduces the impact sound when the movable contact 40 comes into contact with the fixed contact 16 and the impact sound when the movable core 28 comes into contact with the fixed core 26.

When the coil 18 is de-energized, on the other hand, the integrated body including the movable core 28 is driven in the direction away from the fixed core by the return spring 30, so that the insulator 34 comes into contact with the movable piece 36 first, and then the integrated body including the movable core 28 and the movable piece 36 are driven in the direction away from the fixed core against the contact pressure spring 38. As a result, the two movable contacts 40 are separated from the two fixed contacts 16 so that the pair of fixed pieces 14 becomes non-conductive.

Then, as the movable core 28 comes into contact with the stopper 15, the movement of the integrated body including the movable core 28 and the movable piece 36 is stopped. The integrated body including the movable core 28 and the movable piece 36 are thereafter returned to a position at which the forces of the return spring 30 and the contact pressure spring 38 are balanced, as illustrated in FIG. 1.

When the integrated body including the movable core 28 moves in the direction away from the fixed core, the first damping space 50 decreases in volume to have positive pressure with the movement of the integrated body including the movable core 28, so that gas flows out to the housing space 104 from the first damping space 50 through the gap between the inner wall surface of the base 12 forming the base recess 125 and the outer peripheral surface of the movable core disk 281.

Moreover, the second damping space 52 increases in volume to have negative pressure with the movement of the integrated body including the movable core 28, so that gas flows into the second damping space 52 from the housing space 104 through the gap between the inner peripheral surface of the plate 22 forming the plate through hole 221 and the outer peripheral surface of the movable core cylinder 282.

Thus, when the integrated body including the movable core 28 is driven in the direction away from the fixed core, the pressure in each of the first damping space 50 and the second damping space 52 acts on the movable core 28 to generate the damping force, which decreases the speed of the integrated body including the movable core 28. This reduces the impact sound when the movable core 28 comes into contact with the stopper 15.

The inflow speed of the gas into the first damping space 50, the outflow speed of the gas out of the first damping space 50, and also the movement speed of the integrated body including the movable core 28 can be adjusted by adjusting the volume of the first damping space 50 or the size of the gap between the inner wall surface of the base 12 forming the base recess 125 and the outer peripheral surface of the movable core disk 281.

Likewise, the inflow speed of the gas into the second damping space 52, the outflow speed of the gas out of the second damping space 52, and also the movement speed of the integrated body including the movable core 28 can be adjusted by adjusting the volume of the second damping space 52 or the size of the gap between the inner peripheral surface of the plate 22 forming the plate through hole 221 and the outer peripheral surface of the movable core cylinder 282.

The present embodiment does not require a diaphragm which is a dedicated part for exerting the damping force, thereby being able to reduce the number of parts and the size of the electromagnetic relay.

With the first damping space 50 and the second damping space 52 (that is, a plurality of damping spaces) formed, even when the pressure receiving area of the movable core 28 is reduced (that is, the outer diameter of the movable core 28 is reduced), the damping force equivalent to that described above can be obtained unlike a case where only one of the first and second damping spaces 50 and 52 is formed. Thus, the plurality of damping spaces enables size reduction of the electromagnetic relay while ensuring a predetermined level of damping force. The damping force can be increased since the plurality of damping spaces is included.

A second embodiment will be described with reference to FIG. 4. The present embodiment omits or simplifies descriptions of parts similar or equivalent to those of the first embodiment.

Figure 4:
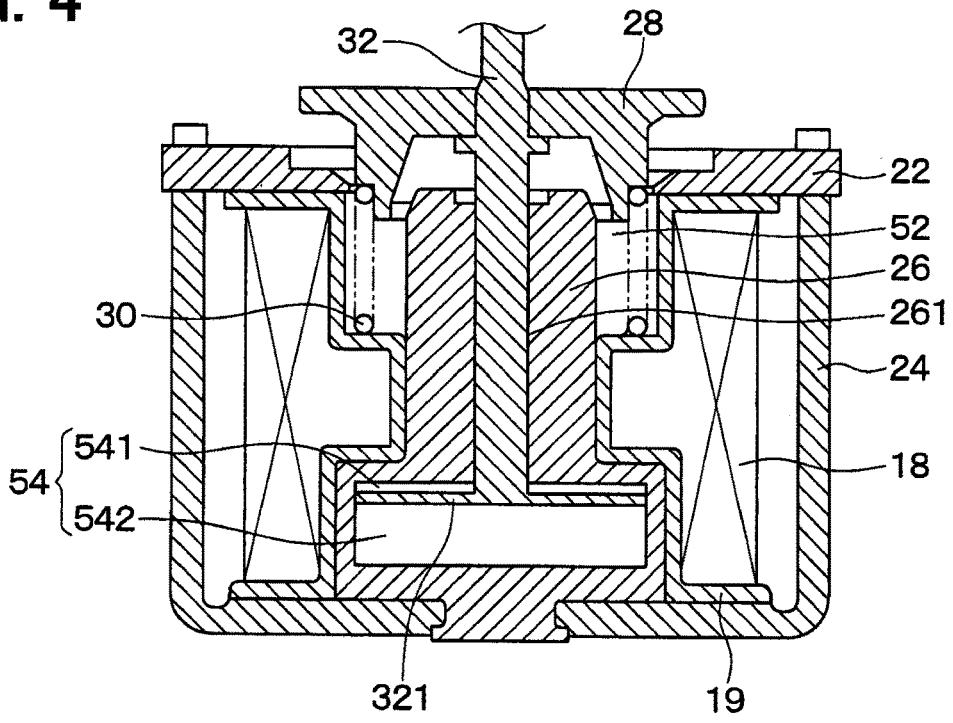
FIG. 4 is a cross-sectional view illustrating the configuration of a part of an electromagnetic relay according to at least one embodiment of the present disclosure.

As illustrated in FIG. 4, a fixed core space 54 with a diameter larger than that of the fixed core guide hole 261 is formed in the fixed core 26 on the side away from the movable core. The fixed core space 54 communicates only with the fixed core guide hole 261.

A shaft disk 321 having a disk shape is formed at an end of the shaft 32 on the side of the fixed core 26 to divide the fixed core space 54 into two spaces. Specifically, a first fixed core damping space 541 is formed on the side of the movable core 28 relative to the shaft disk 321, and a second fixed core damping space 542 is formed on the side away from the movable core relative to the shaft disk 321.

Next, the operation of the electromagnetic relay according to the present embodiment will be described. First, when the integrated body including the movable core 28 is attracted toward the fixed core 26 by the attraction generated in the fixed core 26, the first fixed core damping space 541 increases in volume to have negative pressure while the second fixed core damping space 542 decreases in volume to have positive pressure.

Thus, when the movable core 28 is attracted toward the fixed core 26, the pressure in each of the first fixed core damping space 541 and the second fixed core damping space 542 acts on the shaft disk 321 to generate the damping force, which decreases the speed of the integrated body including the movable core 28.

On the other hand, when the integrated body including the movable core 28 is driven in the direction away from the fixed core by the return spring 30, the first fixed core damping space 541 has positive pressure while the second fixed core damping space 542 has negative pressure.

Thus, when the movable core 28 is driven in the direction away from the fixed core, the pressure in each of the first fixed core damping space 541 and the second fixed core damping space 542 acts on the shaft disk 321 to generate the damping force, which decreases the speed of the integrated body including the movable core 28.

The present embodiment can obtain an effect similar to that of the first embodiment. Moreover, a larger damping force can be obtained with the first fixed core damping space 541 and the second fixed core damping space 542 being formed.

A third embodiment will be described with reference to FIG. 5. The present embodiment omits or simplifies descriptions of parts similar or equivalent to those of the first embodiment.

Figure 5:
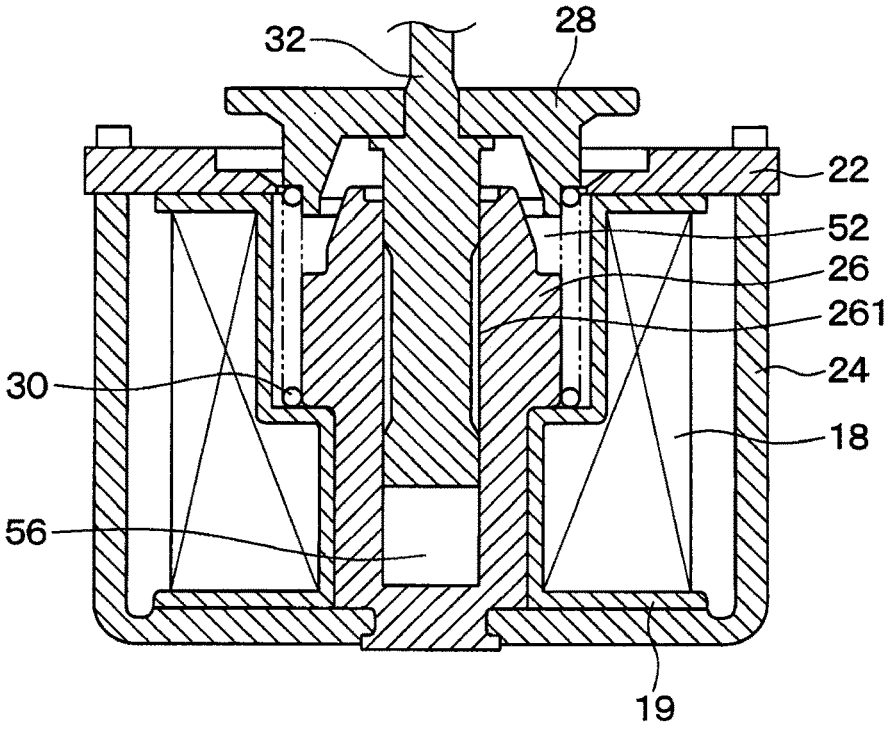
FIG. 5 is a cross-sectional view illustrating the configuration of a part of an electromagnetic relay according to at least one embodiment of the present disclosure.

As illustrated in FIG. 5, the fixed core guide hole 261 is closed at one end on the side of the fixed core 26. A fixed core damping space 56 is formed by an end surface of the shaft 32 on the side of the fixed core 26 and the fixed core 26.

Next, the operation of the electromagnetic relay according to the present embodiment will be described. First, when the integrated body including the movable core 28 is attracted toward the fixed core 26 by the attraction generated in the fixed core 26, the fixed core damping space 56 decreases in volume to have positive pressure.

Thus, when the movable core 28 is attracted toward the fixed core 26, the pressure in the fixed core damping space 56 acts on the end surface of the shaft 32 on the side of the fixed core 26 to generate the damping force, which decreases the speed of the integrated body including the movable core 28.

On the other hand, when the integrated body including the movable core 28 is driven in the direction away from the fixed core by the return spring 30, the fixed core damping space 56 increases in volume to have negative pressure.

Thus, when the movable core 28 is driven in the direction away from the fixed core 26, the pressure in the fixed core damping space 56 acts on the end surface of the fixed core 26 of the shaft 32 to generate the damping force, which decreases the speed of the integrated body including the movable core 28.

The present embodiment can obtain an effect similar to that of the first embodiment. Moreover, a larger damping force can be obtained with the fixed core damping space 56 being formed.

A fourth embodiment will be described with reference to FIG. 6. The present embodiment omits or simplifies descriptions of parts similar or equivalent to those of the first embodiment.

Figure 6:
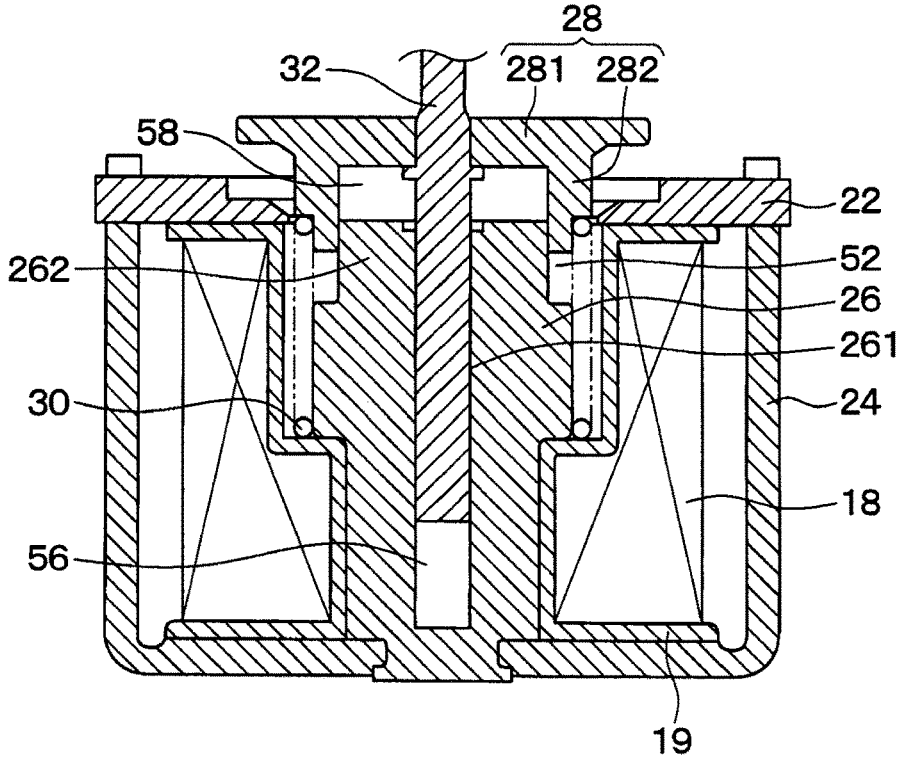
FIG. 6 is a cross-sectional view illustrating the configuration of a part of an electromagnetic relay according to at least one embodiment of the present disclosure.

As illustrated in FIG. 6, the fixed core guide hole 261 is closed at the end on the side of the fixed core 26. A fixed core damping space 56 is formed by an end surface of the shaft 32 on the side of the fixed core 26 and the fixed core 26.

The movable core cylinder 282 has a uniform inner diameter. A fixed core cylinder 262 with a uniform outer diameter is formed at an end of the fixed core 26 on the side of the movable core 28. The fixed core cylinder 262 is slidably and airtightly inserted into the movable core cylinder 282 to form an inter-core damping space 58 with the fixed core 26 and the movable core 28.

Next, the operation of the electromagnetic relay according to the present embodiment will be described. First, when the integrated body including the movable core 28 is attracted toward the fixed core 26 by the attraction generated in the fixed core 26, the fixed core damping space 56 and the inter-core damping space 58 decrease in volume to have positive pressure.

Thus, when the movable core 28 is attracted toward the fixed core 26, the pressures in the fixed core damping space 56 and the inter-core damping space 58 act on the movable core 28 and the shaft 32 to generate the damping force, which decreases the speed of the integrated body including the movable core 28.

On the other hand, when the integrated body including the movable core 28 is driven in the direction away from the fixed core by the return spring 30, the fixed core damping space 56 and the inter-core damping space 58 increase in volume to have negative pressure.

Thus, when the movable core 28 is attracted toward the fixed core 26, the pressures in the fixed core damping space 56 and the inter-core damping space 58 act on the movable core 28 and the shaft 32 to generate the damping force, which decreases the speed of the integrated body including the movable core 28.

The present embodiment can obtain an effect similar to that of the first embodiment. Moreover, a larger damping force can be obtained with the fixed core damping space 56 and the inter-core damping space 58 being formed.

Figure 7:
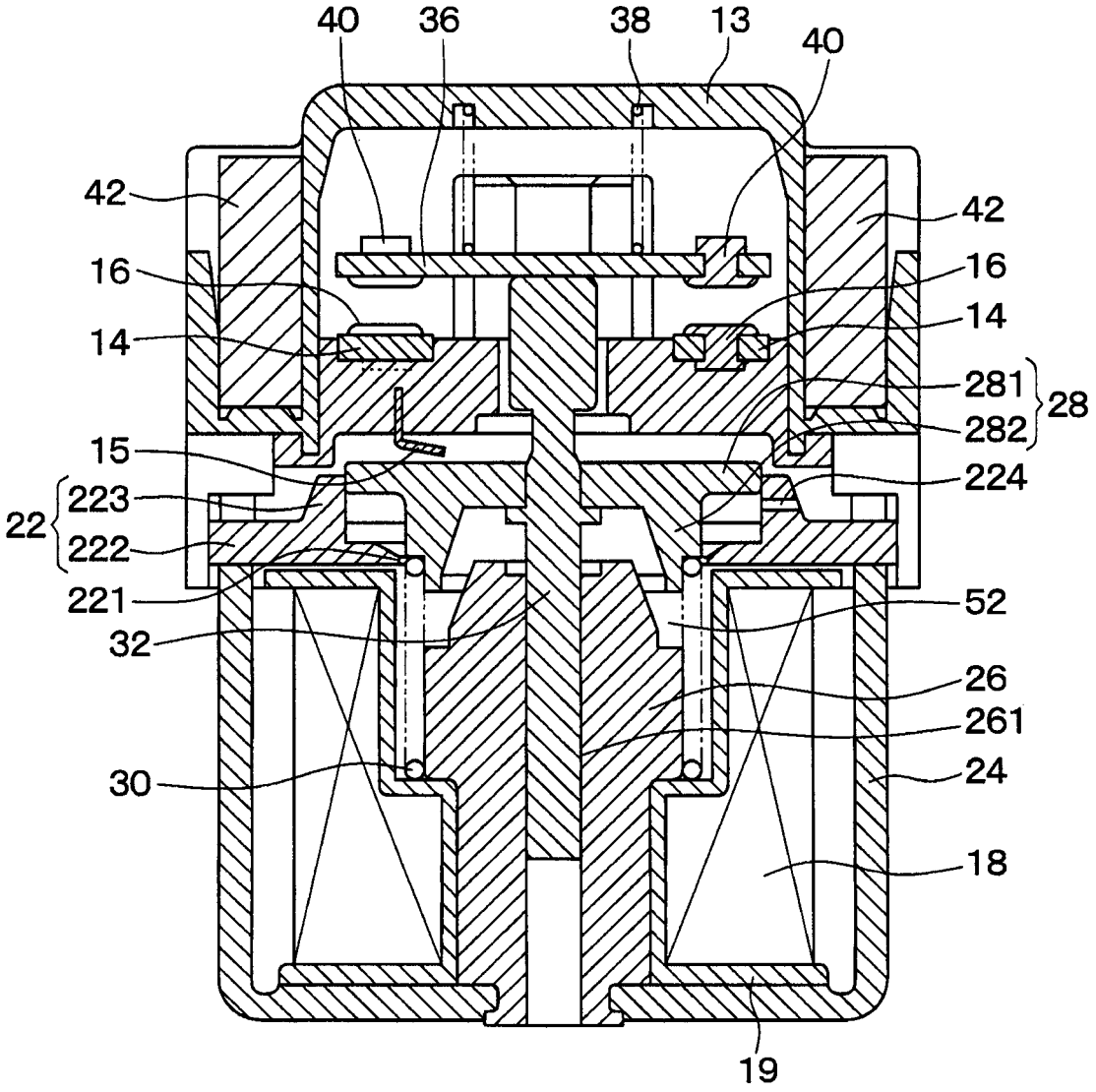
FIG. 7 is a cross-sectional view illustrating an electromagnetic relay according to at least one embodiment of the present disclosure.

A fifth embodiment will be described with reference to FIG. 7. FIG. 7 illustrates a state in which the case 10 (see FIG. 2) is removed. The present embodiment omits or simplifies descriptions of parts similar or equivalent to those of the first embodiment.

As illustrated in FIG. 7, the first damping space 50 and the insulator 34 of the first embodiment are removed in the electromagnetic relay of the present embodiment.

The plate 22 includes a plate disk 222 having a disk shape and a plate cylinder 223 having a substantially cylindrical shape and extending from the plate disk 222 in the direction away from the fixed core. The movable core 28 is inserted into the plate 22. More specifically, the movable core disk 281 is fitted in the plate cylinder 223.

The second damping space 52 is formed on the inner peripheral side of the plate 22 and the spool 19 with an end of the space being substantially closed by the movable core disk 281. More specifically, the second damping space 52 communicates with the housing space 104 at all times through a minute gap between the inner peripheral surface of the plate cylinder 223 and the outer peripheral surface of the movable core disk 281.

In the present embodiment, a gap between the inner peripheral surface of the plate 22 forming the plate through hole 221 and the outer peripheral surface of the movable core cylinder 282 is set sufficiently larger than the gap between the inner peripheral surface of the plate cylinder 223 and the outer peripheral surface of the movable core disk 281.

A plate communication hole 224 is formed in the plate cylinder 223 and allows the second damping space 52 to communicate with the housing space 104 when the coil 18 is not energized. The plate communication hole 224 is an example of a communication hole that is formed in the aforementioned fixed component of the electromagnetic relay to serve as a passage allowing gas to flow into and out of the damping space in a part of the entire range of movement of the aforementioned mobile component.

Next, the operation of the electromagnetic relay according to the present embodiment will be described. First, when the coil 18 is energized, the movable core 28 and the shaft 32 are attracted toward the fixed core 26 by the attraction generated in the fixed core 26 against the return spring 30, and the movable piece 36 is energized by the contact pressure spring 38 to follow the integrated body including the movable core 28.

The second damping space 52 decreases in volume with the movement of the movable core 28 and the shaft 32 within a predetermined range of movement at the beginning of the movement of the movable core 28 and the shaft 32, more specifically, a range of movement before the plate communication hole 224 is closed by the movable core cylinder 282. At this time, the gas in the second damping space 52 flows out to the housing space 104 through the gap between the inner peripheral surface of the plate cylinder 223 and the outer peripheral surface of the movable core disk 281 and through the plate communication hole 224, so that the pressure in the second damping space 52 does not increase.

That is, no damping force is generated in the range of movement before the plate communication hole 224 is closed by the movable core cylinder 282, so that the movable core 28 and the shaft 32 do not slow down and that a response delay of the electromagnetic relay is reduced. In other words, the mobile component moves quickly in the range of movement where the plate communication hole 224 is open, thereby being able to prevent reduction in responsiveness.

The plate communication hole 224 is closed by the movable core cylinder 282 before the two movable contacts 40 come into contact with the two fixed contacts 16.

After the plate communication hole 224 is closed by the movable core cylinder 282, the gas flows out from the second damping space 52 into the housing space 104 through the gap between the inner peripheral surface of the plate cylinder 223 and the outer peripheral surface of the movable core disk 281 with the movement of the movable core 28 and the shaft 32.

The gap between the inner peripheral surface of the plate cylinder 223 and the outer peripheral surface of the movable core disk 281 is set such that the second damping space 52 has pressure that causes the damping force to act on the movable core 28 and the shaft 32 when the second damping space 52 changes in volume.

Thus, after the plate communication hole 224 is closed by the movable core cylinder 282, the pressure in the second damping space 52 acts on the movable core 28 with the movement of the movable core 28 and the shaft 32 to generate the damping force, which decreases the speed of the movable core 28 and the shaft 32.

This reduces the impact sound when the movable contact 40 comes into contact with the fixed contact 16 and the impact sound when the movable core 28 comes into contact with the fixed core 26.

When the coil 18 is de-energized, on the other hand, the movable core 28 and the shaft 32 are driven in the direction away from the fixed core by the return spring 30, so that the shaft 32 comes into contact with the movable piece 36 first, and then the movable core 28, the shaft 32, and the movable piece 36 are driven in the direction away from the fixed core against the contact pressure spring 38. As a result, the two movable contacts 40 are separated from the two fixed contacts 16 so that the pair of fixed pieces 14 becomes non-conductive.

Then, as the movable core 28 comes into contact with the stopper 15, the movement of the movable core 28, the shaft 32, and the movable piece 36 is stopped. The movable core 28, the shaft 32, and the movable piece 36 are thereafter returned to a position at which the forces of the return spring 30 and the contact pressure spring 38 are balanced as shown in FIG. 7.

Here, when the movable core 28 and the shaft 32 are moved in the direction away from the fixed core, the second damping space 52 increases in volume to have negative pressure with the movement of the movable core 28 and the shaft 32 until the second damping space 52 communicates with the housing space 104 through the plate communication hole 224, so that the pressure in the second damping space 52 acts on the movable core 28 to generate the damping force, which decreases the speed of the movable core 28 and the shaft 32. This reduces the impact sound when the movable core 28 comes into contact with the stopper 15.

The present embodiment does not require a diaphragm which is a dedicated part for exerting the damping force, thereby being able to reduce the number of parts and the size of the electromagnetic relay.

Moreover, the plate communication hole 224 can reduce the response delay of the electromagnetic relay when the coil 18 is energized.

Figure 8:
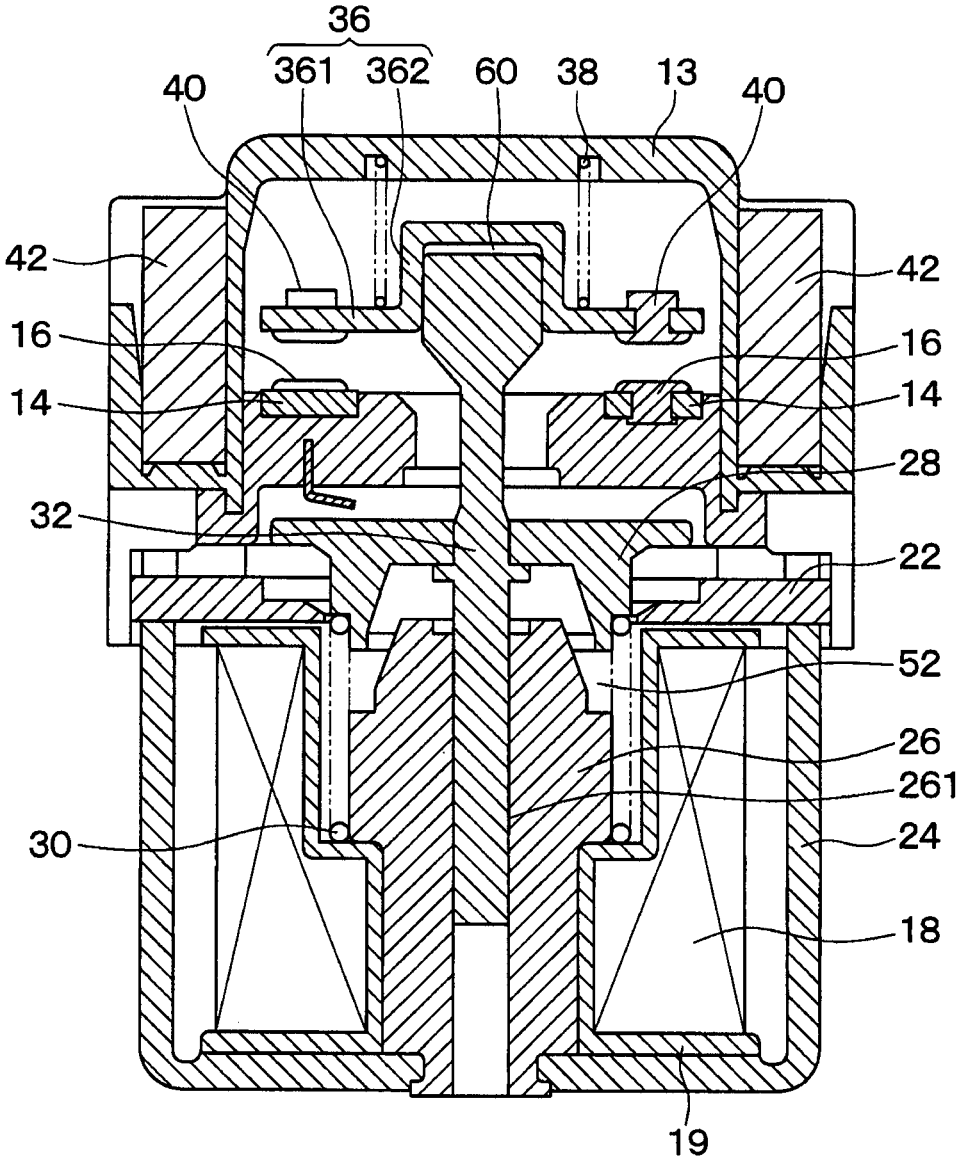
FIG. 8 is a cross-sectional view illustrating an electromagnetic relay according to at least one embodiment of the present disclosure.

A sixth embodiment will be described with reference to FIG. 8. FIG. 8 illustrates a state in which the case 10 (see FIG. 2) is removed. The present embodiment omits or simplifies descriptions of parts similar or equivalent to those of the first embodiment.

As illustrated in FIG. 8, the first damping space 50, the second damping space 52, and the insulator 34 of the first embodiment are removed in the electromagnetic relay of the present embodiment.

The movable piece 36 includes a movable piece plate 361 which has a plate shape and to which the movable contact 40 is fixed, and a movable piece cylinder 362 which has a bottomed cylindrical shape and projects from the movable piece plate 361 in the direction away from the fixed core. The movable piece cylinder 362 is open on the side of the fixed core 26.

The end of the shaft 32 on the side of the movable piece 36 is slidably and airtightly inserted into the space in the movable piece cylinder 362 to form a movable piece damping space 60 with the shaft 32 and the movable piece 36.

Next, the operation of the electromagnetic relay according to the present embodiment will be described. First, when the coil 18 is not energized, the end surface of the shaft 32 on the side of the movable piece 36 is in contact with a bottom wall of the movable piece cylinder 362.

When the coil 18 is energized in such a state, the movable core 28 and the shaft 32 are attracted toward the fixed core 26 by the attraction generated in the fixed core 26 against the return spring 30, and the movable piece 36 is energized by the contact pressure spring 38 to follow the movable core 28 and the shaft 32. As a result, the two movable contacts 40 come into contact with the two fixed contacts 16 so that a pair of fixed pieces 14 becomes conductive.

After the movable contacts 40 come into contact with the fixed contacts 16, the movable core 28 and the shaft 32 further move to a position at which the movable core 28 comes into contact with the fixed core 26.

At this time, with the movement of the movable core 28 and the shaft 32, the movable piece damping space 60 increases in volume to have negative pressure so that gas flows into the movable piece damping space 60 from the housing space 104 through a gap between the outer peripheral surface of the shaft 32 and the inner peripheral surface of the movable piece cylinder 362.

In the present embodiment, the gap between the outer peripheral surface of the shaft 32 and the inner peripheral surface of the movable piece cylinder 362 is set such that the movable piece damping space 60 has pressure that causes the damping force to act on the movable core 28 and the shaft 32 when the movable piece damping space 60 changes in volume.

Thus, when the movable core 28 and the shaft 32 are attracted toward the fixed core 26, the pressure in the movable piece damping space 60 acts on the movable core 28 to generate the damping force, which decreases the speed of the movable core 28 and the shaft 32. This reduces the impact sound when the movable core 28 comes into contact with the fixed core 26.

When the coil 18 is de-energized, on the other hand, the movable core 28 and the shaft 32 are driven in the direction away from the fixed core by the return spring 30, so that, with the movement of the movable core 28 and the shaft 32, the movable piece damping space 60 decreases in volume to have positive pressure and that gas flows out to the housing space 104 from the movable piece damping space 60 through the gap between the outer peripheral surface of the shaft 32 and the inner peripheral surface of the movable piece cylinder 362.

As the pressure in the movable piece damping space 60 rises, the movable piece 36 is driven in the direction away from the fixed core against the contact pressure spring 38, so that the two movable contacts 40 are separated from the two fixed contacts 16 and that the pair of fixed pieces 14 becomes non-conductive.

The movable piece damping space 60 has positive pressure when the movable core 28 and the shaft 32 move in the direction away from the fixed core, whereby the pressure in the movable piece damping space 60 acts on the shaft 32 to generate the damping force, which decreases the speed of the movable core 28 and the shaft 32. This reduces the impact sound when the movable core 28 comes into contact with the stopper 15.

The present embodiment does not require a diaphragm which is a dedicated part for exerting the damping force, thereby being able to reduce the number of parts and the size of the electromagnetic relay.

Figure 9:
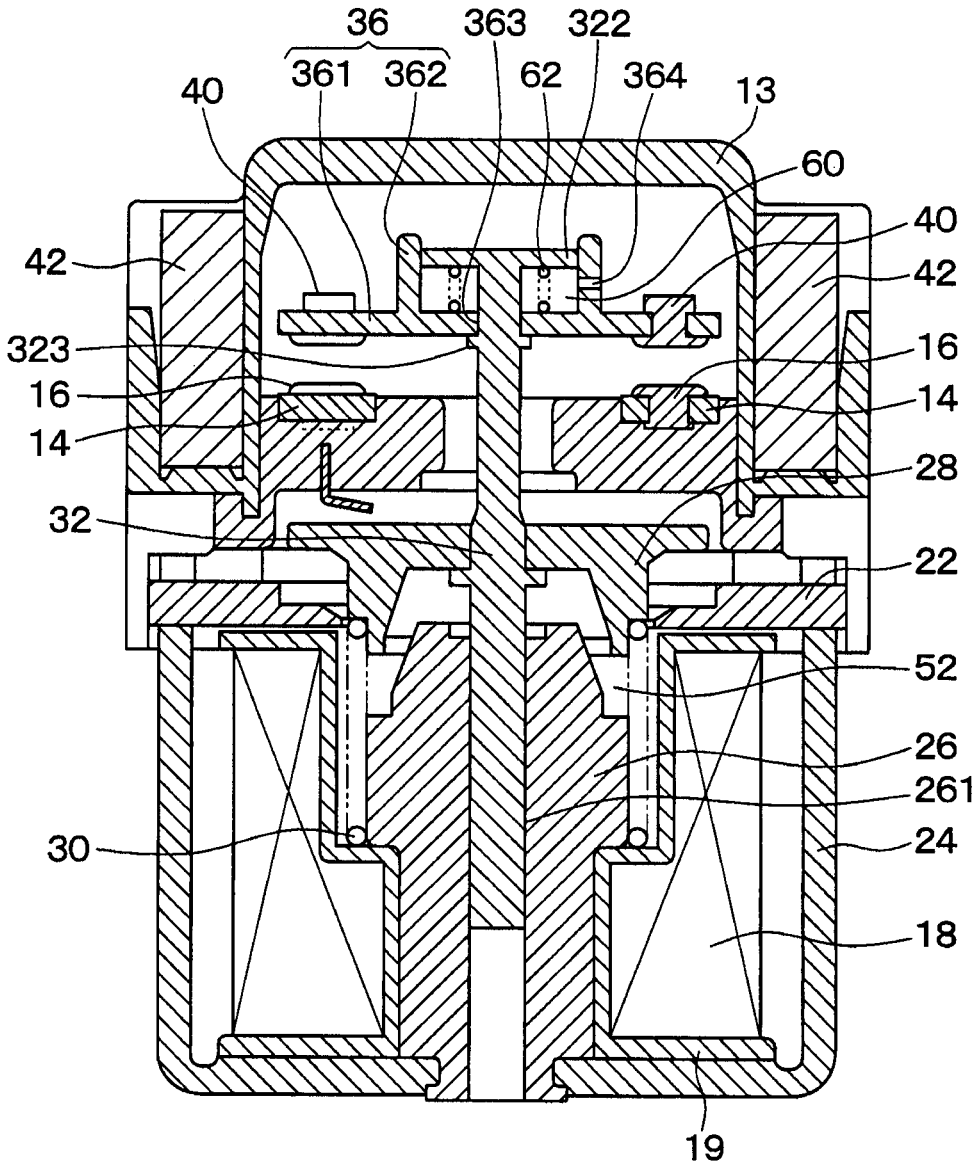
FIG. 9 is a cross-sectional view illustrating an electromagnetic relay according to at least one embodiment of the present disclosure.

A seventh embodiment will be described with reference to FIG. 9. FIG. 9 illustrates a state in which the case 10 (see FIG. 2) is removed. The present embodiment omits or simplifies descriptions of parts similar or equivalent to those of the first embodiment.

As illustrated in FIG. 9, the first damping space 50, the second damping space 52, the insulator 34, and the contact pressure spring 38 of the first embodiment are removed in the electromagnetic relay of the present embodiment.

The movable piece 36 includes a movable piece plate 361 which has a plate shape and to which the movable contact 40 is fixed, and a movable piece cylinder 362 which has a cylindrical shape and projects from the movable piece plate 361 in the direction away from the fixed core. The space in the movable piece cylinder 362 is closed on the side of the fixed core 26 by the movable piece plate 361 and open on the side away from the fixed core.

A movable piece through hole 363 passing through the movable piece plate 361 is formed in a part thereof that closes the space in the movable piece cylinder 362, and the shaft 32 is slidably and airtightly inserted into the movable piece through hole 363.

A shaft disk 322 having a disk shape is formed at the end of the shaft 32 on the side of the movable piece 36 and is slidably and airtightly inserted into the space in the movable piece cylinder 362. The movable piece damping space 60 is formed by the part of the movable piece plate 361 closing the space in the movable piece cylinder 362, the movable piece cylinder 362, and the shaft disk 322.

The movable piece damping space 60 houses a shaft holding spring 62 for energizing the shaft 32 in a direction to move the shaft disk 322 away from the movable piece plate 361. When the coil 18 is not energized, a shaft stopper plate 323 formed on the shaft 32 is in contact with the movable piece plate 361 to determine the relative position between the shaft 32 and the movable piece 36.

A movable piece communication hole 364 is formed in the movable piece cylinder 362 and allows the movable piece damping space 60 to communicate with the housing space 104 when the coil 18 is not energized. The movable piece communication hole 364 is an example of a communication hole that is formed in the aforementioned movable contact of the electromagnetic relay to serve as a passage allowing gas to flow into and out of the damping space in a part of the range of relative movement between the shaft 32 and the movable contact.

Next, the operation of the electromagnetic relay according to the present embodiment will be described. First, when the coil 18 is energized, the movable core 28, the shaft 32, and the movable piece 36 are attracted toward the fixed core 26 by the attraction generated in the fixed core 26 against the return spring 30. The two movable contacts 40 thus come into contact with the two fixed contacts 16 so that the pair of fixed pieces 14 becomes conductive.

After the movable contacts 40 come into contact with the fixed contacts 16 and the movable piece 36 is stopped, the movable core 28 and the shaft 32 further move to a position at which the movable core 28 comes into contact with the fixed core 26. That is, the movable core 28 and the shaft 32 move relative to the movable piece 36.

The movable piece damping space 60 decreases in volume with the movement of the movable core 28 and the shaft 32 within a predetermined range of movement at the beginning of the relative movement, specifically, a range of movement before the movable piece communication hole 364 is closed by the shaft disk 322. At this time, the gas in the movable piece damping space 60 flows out to the housing space 104 through a gap between the inner peripheral surface of the movable piece cylinder 362 and the outer peripheral surface of the shaft disk 322 and through the movable piece communication hole 364, so that the pressure in the movable piece damping space 60 does not increase.

That is, no damping force is generated in the range of movement before the movable piece communication hole 364 is closed by the shaft disk 322. The movable core 28 and the shaft 32 thus move quickly to increase the load of the shaft holding spring 62, whereby the force pressing the movable contacts 40 against the fixed contacts 16 increases rapidly. In other words, the shaft 32 and the movable core 28 move quickly in the range of movement where the movable piece communication hole 364 is open, thereby being able to prevent reduction in responsiveness.

After the movable piece communication hole 364 is closed by the shaft disk 322, the gas flows out from the movable piece damping space 60 into the housing space 104 through the gap between the inner peripheral surface of the movable piece cylinder 362 and the outer peripheral surface of the shaft disk 322 with the movement of the movable core 28 and the shaft 32.

The gap between the inner peripheral surface of the movable piece cylinder 362 and the outer peripheral surface of the shaft disk 322 is set such that the movable piece damping space 60 has pressure that causes the damping force to act on the movable core 28 and the shaft 32 when the movable piece damping space 60 changes in volume.

Thus, after the movable piece communication hole 364 is closed by the shaft disk 322, the pressure in the movable piece damping space 60 acts on the movable core 28 with the movement of the movable core 28 and the shaft 32 to generate the damping force, which decreases the speed of the movable core 28 and the shaft 32. This reduces the impact sound when the movable core 28 comes into contact with the fixed core 26.

When the coil 18 is de-energized, on the other hand, the movable core 28, the shaft 32, and the movable piece 36 are driven in the direction away from the fixed core by the return spring 30. The two movable contacts 40 are thus separated from the two fixed contacts 16 first, and then the pair of fixed pieces 14 becomes non-conductive.

The movable piece 36 is driven to a position at which the shaft stopper plate 323 is brought into contact with the movable piece plate 361 by the shaft holding spring 62.

The present embodiment does not require a diaphragm which is a dedicated part for exerting the damping force, thereby being able to reduce the number of parts and the size of the electromagnetic relay.

Moreover, the movable piece communication hole 364 is formed to be able to rapidly increase the force for pressing the movable contacts 40 against the fixed contacts 16 when the coil 18 is energized.

The present disclosure is not limited to the above embodiments but can be modified as appropriate within the scope described in the present disclosure.

The above embodiments are not independent of one another but can be combined as appropriate unless clearly not combinable.

It goes without saying that the components included in the above embodiments are not necessarily required unless specified as being required, regarded as being clearly required in principle, or the like.

The numerical value such as the number, the numerical value, the quantity, the range, or the like of a component mentioned in the above embodiments is not limited to a specific number unless specified as being required, clearly limited to such a specific number in principle, or the like.

The shape, the positional relationship, and the like of a component or the like mentioned in the above embodiments are not limited to those being mentioned unless otherwise specified, limited to specific shape, positional relationship, and the like in principle, or the like.

A comparative example will be described below. In the comparative example, a damper device is provided in an electromagnetic relay for exerting a damping force on the movable core and the movable contact when they are moving, and thereby reduces impact speed when the movable contact comes into contact with the fixed contact. For example, a diaphragm in shape of a cup having therein a damping space is used as the damper device.

However, according to a study by the inventor, the electromagnetic relay of the comparative example including the diaphragm which is a dedicated part for exerting the damping force may result in an increase in the number of parts. The diaphragm may also increase the size of the electromagnetic relay in order to secure the space for installing the diaphragm.

In contrast, according to the present disclosure, a number of parts and a size of an electromagnetic relay can be reduced while a damping force is exerted in the electromagnetic relay.

According to a first aspect of the present disclosure, an electromagnetic relay includes: a coil configured to form a magnetic field when energized; a fixed component including a fixed core constituting a magnetic circuit and configured to generate attraction when the coil is energized, the fixed component being immovable at time of energization and de-energization of the coil; a mobile component including a movable core constituting a magnetic circuit and attracted toward the fixed core by the attraction, the mobile component being movable at the time of energization and de-energization of the coil; a fixed contact fixed to a base; and a movable contact configured to follow the movable core to come into contact with and separate from the fixed contact. A damping space is provided between the mobile component and the fixed component and changes in volume with a movement of the mobile component. A gap is provided between the mobile component and the fixed component, and the gap serves as a passage that allows gas to flow into or out of the damping space when the damping space changes in volume. A size of the gap is set such that a pressure is generated in the damping space to cause a damping force acting on the mobile component when the damping space changes in volume.

According to a second aspect of the present disclosure, an electromagnetic relay includes: a coil configured to form a magnetic field when energized; a fixed core constituting a magnetic circuit and configured to generate attraction when the coil is energized; a movable core constituting a magnetic circuit and attracted toward the fixed core by the attraction; a shaft integrated with the movable core; a fixed contact fixed to a base; and a movable contact configured to follow the movable core to come into contact with and separate from the fixed contact. A damping space is defined by the shaft and the movable contact and changes in volume with a relative movement of the shaft and the movable contact. A gap is provided between the shaft and the movable contact, and the gap serves as a passage that allows gas to flow into or out of the damping space when the damping space changes in volume. A size of the gap is set such that a pressure is generated in the damping space to cause a damping force acting on the shaft and the movable core when the damping space changes in volume.

The first and second aspects above do not require a diaphragm which is a dedicated part for exerting a damping force, thereby being able to reduce the number of parts and the size of the electromagnetic relay.

While the present disclosure has been described with reference to embodiments thereof, it is to be understood that the disclosure is not limited to the embodiments and constructions. To the contrary, the present disclosure is intended to cover various modification and equivalent arrangements. In addition, while the various elements are shown in various combinations and configurations, which are exemplary, other combinations and configurations, including more, less or only a single element, are also within the spirit and scope of the present disclosure.

What is claimed is:

1. An electromagnetic relay comprising:

a coil configured to form a magnetic field when energized;

a fixed component including a fixed core constituting a magnetic circuit and configured to generate attraction when the coil is energized, the fixed component being immovable at time of energization and de-energization of the coil;

a mobile component including a movable core constituting a magnetic circuit and attracted toward the fixed core by the attraction, the mobile component being movable at the time of energization and de-energization of the coil;

a fixed contact fixed to a base; and a movable contact configured to follow the movable core to come into contact with and separate from the fixed contact, wherein:

a damping space is provided between the mobile component and the fixed component and changes in volume with a movement of the mobile component;

a gap is provided between the mobile component and the fixed component, and the gap serves as a passage that allows gas to flow into or out of the damping space when the damping space changes in volume; and a size of the gap is set such that a pressure is generated in the damping space to cause a damping force acting on the mobile component when the damping space changes in volume.

2. The electromagnetic relay according to claim 1, wherein the damping space is one of a plurality of the damping spaces.

3. The electromagnetic relay according to claim 2, wherein the plurality of damping spaces is formed such that at least one of the damping spaces increases in volume when at least another of the damping spaces decreases in volume.

4. The electromagnetic relay according to claim 1, wherein a communication hole is formed in the fixed component, and the communication hole serves as a passage that allows gas to flow into or out of the damping space when the mobile component is within a part of an entire range of movement of the mobile component.

5. An electromagnetic relay comprising:

a coil configured to form a magnetic field when energized;

a fixed core constituting a magnetic circuit and configured to generate attraction when the coil is energized;

a movable core constituting a magnetic circuit and attracted toward the fixed core by the attraction;

a shaft integrated with the movable core;

a fixed contact fixed to a base; and a movable contact configured to follow the movable core to come into contact with and separate from the fixed contact, wherein:

a damping space is defined by the shaft and the movable contact and changes in volume with a relative movement of the shaft and the movable contact;

a gap is provided between the shaft and the movable contact, and the gap serves as a passage that allows gas to flow into or out of the damping space when the damping space changes in volume; and a size of the gap is set such that a pressure is generated in the damping space to cause a damping force acting on the shaft and the movable core when the damping space changes in volume.

6. The electromagnetic relay according to claim 5, wherein a communication hole is formed in the movable contact, and the communication hole serves as a passage that allows gas to flow into or out of the damping space when the mobile component is within a part of a range of relative movement of the shaft and the movable contact.

7. An electromagnetic relay comprising:

a coil configured to form a magnetic field when energized;

a fixed component immovable at time of energization and de-energization of the coil; and a mobile component movable at the time of energization and de-energization of the coil is energized and de-energized, wherein:

a damping space is provided between the mobile component and the fixed component and changes in volume with a movement of the mobile component;

a gap is provided between the mobile component and the fixed component, and the gap serves as a passage that allows gas to flow into or out of the damping space when the damping space changes in volume; and a size of the gap is set such that a pressure is generated in the damping space to cause a damping force acting on the mobile component when the damping space changes in volume.

* * * * *